US005281154A

United States Patent [19]

Comerci et al.

[11] Patent Number: 5,281,154

[45] Date of Patent: Jan. 25, 1994

[54] ELECTRICAL CONNECTOR ASSEMBLY WITH PRINTED CIRCUIT BOARD LAYOUT

[75] Inventors: Joseph D. Comerci, Elmhurst; Burke J. Crane, Lombard; Robert DeRoss, Naperville, all of Ill.; James K. Hollomon, Jr., Virginia Beach, Va.; Preston B. Johnson, Virginia Beach, Va.; Garth S. Jones, Virginia Beach, Va.; Kevin L. Nelson, Virginia Beach, Va.; Michael J. O'Connell, Naperville, Ill.

[73] Assignee: Molex Incorporated, Lisle, Ill.

[21] Appl. No.: 981,150

[22] Filed: Nov. 24, 1992

[51] Int. Cl.[5] ..... H01R 13/66

[52] U.S. Cl. ..... 439/107; 336/107; 361/707; 361/816; 439/487; 439/535

[58] Field of Search ..... 439/74, 76, 107, 620, 439/607, 650, 651, 535, 487; 361/386, 388, 395, 399, 424, 412, 413; 336/61, 107

[56] References Cited

U.S. PATENT DOCUMENTS

| | | | |
|---|---|---|---|
| 3,147,402 | 9/1964 | Hochstetler | 361/388 |
| 3,676,745 | 7/1972 | Traweek | 361/388 |
| 4,159,506 | 6/1979 | Latasiewicz | 361/399 |
| 4,519,015 | 5/1985 | Lin | 336/107 |
| 4,661,792 | 4/1987 | Watkins | 336/65 |
| 4,661,888 | 4/1987 | Jewell et al. | 174/35 GC |
| 4,762,500 | 8/1988 | Dola et al. | 439/79 |
| 5,107,404 | 4/1992 | Tam | 361/424 |

FOREIGN PATENT DOCUMENTS 3352198 11/1991 Japan .

*Primary Examiner*—Neil Abrams
*Attorney, Agent, or Firm*—Stephen Z. Weiss

[57] ABSTRACT

An electrical connector assembly includes a pair of spaced receptacle modules mounted to a first printed circuit board which is electrically coupled to a second printed circuit board spaced from and generally parallel to the first printed circuit board. A conductive ground plate is electrically coupled between the printed circuit boards and mechanically supports the circuit boards in their spaced generally parallel relationship. The ground plate is disposed perpendicular to the first and second printed circuit boards forming two separate compartments between the first and second printed circuit boards to provide electromagnetic interference isolation between the compartments. An electrical component such as transformer may be mounted on one side of the ground plate between the spaced generally parallel printed circuit boards, and the ground plate provides a heat sink for the transformer. A third printed circuit board may be mounted on the side of the ground plate opposite the transformer and electrically coupled to the transformer through the ground plate.

9 Claims, 4 Drawing Sheets

ELECTRICAL CONNECTOR ASSEMBLY WITH PRINTED CIRCUIT BOARD LAYOUT

FIELD OF THE INVENTION

This invention generally relates to the art of electrical connectors and, particularly, to an electrical connector assembly which includes printed circuit boards incorporated directly into the assembly.

BACKGROUND OF THE INVENTION

In certain applications, it is desirable or necessary to incorporate printed circuit boards directly into an electrical connector assembly. In other words, the assembly may include one or more connector modules, such as receptacle modules, interconnected to a printed circuit board. The connector modules and printed circuit board are encapsulated within a common housing, and terminals project from the housing for interconnection with other exterior circuit components. In fact, in certain applications, it is desirable or necessary to incorporate a plurality of circuit boards in the connector assembly, such as a pair of spaced generally parallel boards.

An example of an application wherein electrical connector assemblies of the character described above are employed is in an environment wherein a connector assembly is used to interconnect both power circuitry as well as data circuitry.; A specific example is in a "Smart House" environment wherein a common receptacle may include a receptacle module which includes both power and data. For ease of manufacturing as well as maintaining a small envelope for the connector assembly, it is desirable to have both the power and the data circuitry in close proximity to each other on a common printed circuit board, or in conjunction with a second, generally parallel printed circuit board.

One of the problems in incorporating both power and data circuitry on a common circuit board layout within a small envelope or confined area is the requirement for electromagnetic interference isolation between the power and data circuitry. For instance, the data circuitry may envision on the order of 5 to 12 volt signals in contrast to the 120 volt power circuitry and to thousands of volts that may appear in the power circuitry during surges and transients. Heretofore, electromagnetic interference isolation in such small electrical connector assemblies has been difficult, if at all possible.

Another problem in electrical connector assemblies of the character described involves heat dissipation from various electronic components. For instance, a transformer might be used in the circuitry and coupled to one and/or the other printed circuit boards. In fact, a third printed circuit board may be employed with the transformer. In the small envelope or confined area of such a connector assembly, adequate heat dissipation from an electronic component, such as a transformer, also has been difficult, if at all possible.

This invention is directed to solving the above problems in an extremely simple manner by employing a single grounded plate coupled between a pair of spaced, generally parallel printed circuit boards, with the ground plate located between the printed circuit boards forming two isolated compartments, to provide mechanical support for the printed circuit boards, to reduce electromagnetic interference and to provide a heat sink for electronic components, such as a transformer.

SUMMARY OF THE INVENTION

An object, therefore, of the invention is to provide a new and improved, compact electrical connector assembly incorporating a printed circuit board and providing electromagnetic interference isolation between compartments within an electrical connector assembly.

In the exemplary embodiment of the invention, the electrical connector assembly includes a pair of spaced receptacle modules mounted to a first printed circuit board which is electrically coupled to a second printed circuit board spaced from and generally parallel to the first printed circuit board. A conductive ground plate is coupled between the printed circuit boards and mechanically supports the circuit boards in their spaced generally parallel relationship. The ground plate is disposed at a location between the first and second printed circuit boards forming two compartments to provide electromagnetic interference isolation therebetween.

The invention also contemplates that a circuit component, such as a transformer, can be mounted on one side of the ground plate between the spaced generally parallel printed circuit boards. The ground plate provides a heat sink for the circuit component. A third printed circuit board may be mounted on the opposite side of the ground plate, and electrically coupled to the transformer therethrough but not electrically connected to the ground plate.

As disclosed herein, the receptacle modules, printed circuit-boards and the ground plate all are encased within a housing having an open front end. A face cover is mounted on the housing closing the open front end thereof, the face cover including aperture means communicating with the receptacle modules. The housing includes a rear wall, and terminal means electrically coupled to the second printed circuit board extend through the rear wall. The ground plate includes a terminal portion or blade extending through the rear wall of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
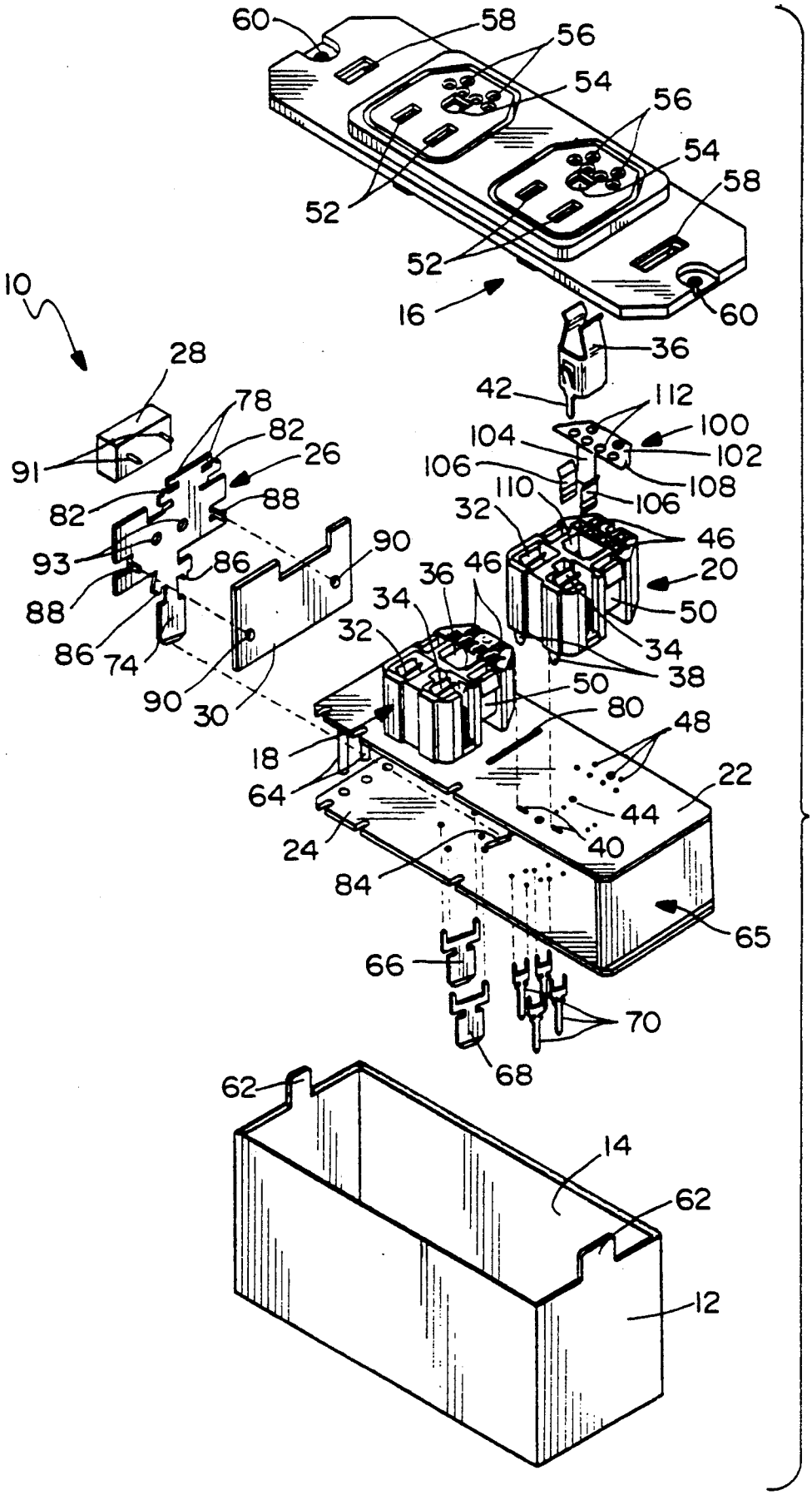
FIG. 1 is an exploded perspective view of an electrical connector assembly embodying the concepts of the invention.

Referring to the drawings in greater detail, and first to FIG. 1, the invention is embodied in an electrical connector assembly, generally designated 10, which includes a box-like housing 12 having an open top 14 as viewed in FIG. 1. If connector assembly 10 is used as a wall receptacle, such as in a "Suart House" application, open top 14 of housing 12 actually would be an open front end of the housing. All of the components of electrical connector assembly 10 are mounted within housing 12, and a face cover, generally designated 16, is positioned onto the housing to close the open front end thereof.

More particularly, the electrical connector assembly includes a pair of spaced receptacle modules, generally designated 18 and 20. The receptacle modules are mounted on and electrically coupled to a first printed circuit board 22. The first printed circuit board is electrically coupled (as described hereinafter) to a second printed circuit board 24 spaced from and generally parallel to first circuit board 22. A conductive ground plate, generally designated 26, is electrically coupled or grounded between circuit boards 22 and 24 and mechanically supports the circuit boards in their spaced generally parallel relationship. A transformer 28 may be mounted to one side of ground plate 26 and coupled to a third printed circuit board 30 without being electrically connected to the ground plate. It should be understood that all of the printed circuit boards 22, 24 and 30 have appropriate circuit traces thereon as is well known in the art. However, the circuit traces for electrically coupling the various components of the connector are not shown in the drawings in order to avoid unnecessarily cluttering the drawings and to facilitate a clear understanding of the invention.

Electrical connector assembly 10 is particularly useful in applications wherein the connector assembly accommodates both high and low voltage circuitry. For instance, as disclosed herein, receptacle modules 18 and 20 include both power terminals for accommodating 120 volt power and data terminals for transmitting 5 to 12 volt data signals. Both receptacle modules 18 and 20 are substantially identical and include a conventional three-pronged terminal configuration including a "hot" terminal 32, a neutral terminal 34 and a ground terminal 36. As can be seen, the terminals are female terminals for receiving complementary terminal pins of a mating complementary connector (not shown). Hot and neutral terminals 32 and 34, respectively, include tail portions 38 for insertion into holes 40 in printed circuit board 22, and ground terminal 36 includes a tail portion 42 for insertion into a hole 44 in printed circuit board 22, for soldering to appropriate circuit traces on the board or in the holes. Receptacle modules 18 and 20 also include a plurality of through passages 46 within which are mounted appropriate data terminals (not visible in the drawings) having tail portions insertable into holes 48 in printed circuit board 22 for soldering to circuit traces on the board or in the holes. As can be seen in FIG. 1, receptacle modules 18 and 20 have latch arms 50 for latching to appropriate latch means on the underside of face cover 16.

Face cover 16 is generally flat and has two arrays of apertures therethrough corresponding to the terminal array of receptacle modules 18 and 20. It can be seen in FIG. 1 that apertures 52 will be aligned with hot and neutral terminals 32 and 34 of the receptacle modules, aperture 54 will be aligned with ground terminal 36, and apertures 56 will be aligned with data terminal passages 46 of the receptacle modules. The face cover also includes a pair of slots 58 for receiving a pair of tabs 60 projecting upwardly from the top of housing 12. Lastly, the face cover includes a pair of mounting holes 60 at opposite ends thereof for facilitating mounting the entire electrical connector assembly 10 to a support structure, such as in an opening in a wall or the like.

Figure 2:
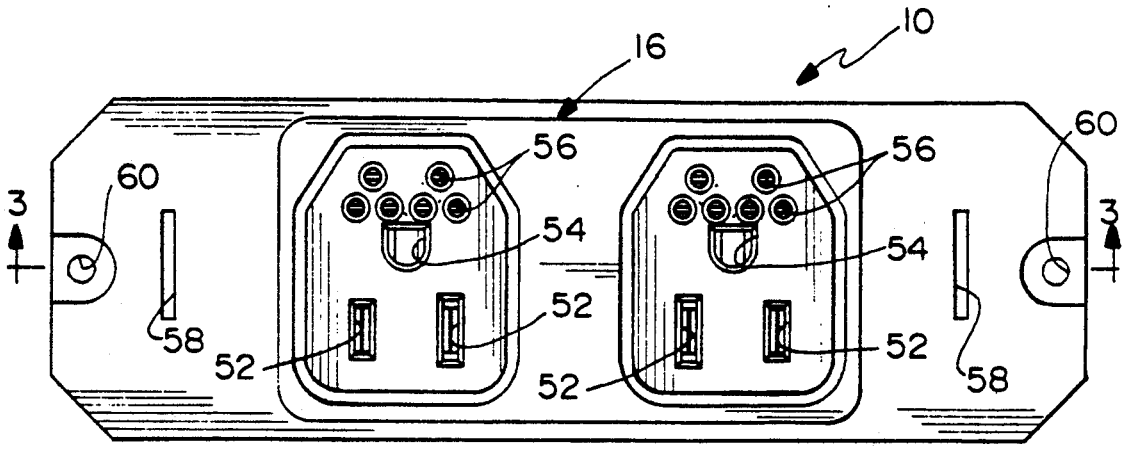
FIG. 2 is a top plan view of the electrical connector assembly.
Figure 3:
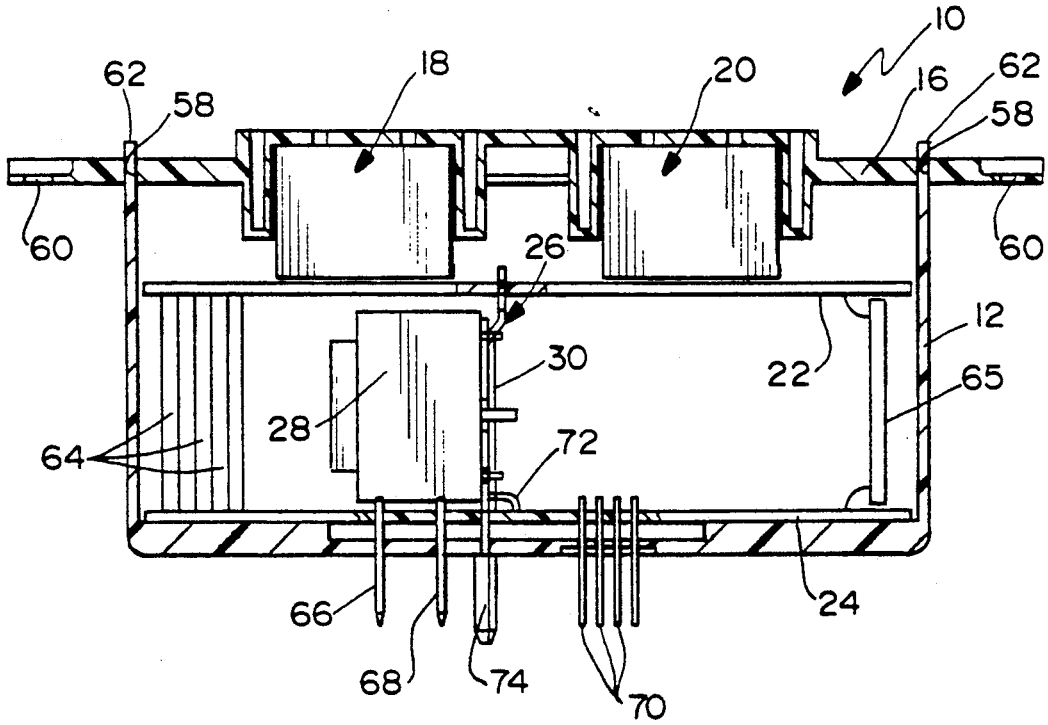
FIG. 3 is a vertical section taken generally along line 3—3 of FIG. 2.

Referring to FIGS. 2 and 3 in conjunction with FIG. 1, it can be seen particularly in FIG. 3 that all of the components including receptacle modules 18 and 20, printed circuit boards 22 and 24, ground plate 26, transformer 28 and third printed circuit board 30 are encased within housing 12. Face cover 16 is mounted onto the housing to close open end 14 thereof. Tabs 62 at the top of the housing project through slots 58 (FIG. 1) of the face cover and are secured in assembly by ultrasonic or heat staking. It can be seen that the ends of the face cover project beyond the housing whereby holes 60 in the face cover can be used to mount the electrical connector assembly to an appropriate support structure.

As seen in FIG. 3, appropriate circuitry, such as buss bars and/or electrical wires 64 and fourth printed circuit board 65, electrically couple printed circuit boards 22 and 24 within housing 12 and, thereby, electrically couple receptacle modules 18 and 20 to the second or lower printed circuit board 24. A "hot" terminal 66 and a neutral terminal 68 extend from second printed circuit board 24 through housing 12 for interconnection with appropriate exterior power circuitry. Of course, terminals 66 and 68 are electrically coupled through the second printed circuit board, circuitry 64 and first printed circuit board 22 to power receptacle terminals 32 and 34.

Data terminals 70 also extend from second printed circuit board 24 through housing 12 for connection to appropriate external circuitry. Like the power terminals 66 and 68, data terminals 70 are electrically coupled to the second printed circuit board 24 which passes through the logic circuitry on printed circuit board 65 to the first printed circuit board 22 and finally to the data terminals of receptacle modules 18 and 20.

As best seen in FIG. 3, ground plate 26 is unique in that it performs a multiplicity of functions within the compact envelope of electrical connector assembly 10. Specifically, the ground plate is electrically coupled between and grounds the two printed circuit boards 22 and 24. Again, appropriate ground traces or paths are provided on the printed circuit boards. Whenever a pair of printed circuit boards are in close proximity, such as the spaced parallel relationship shown and described herein, there is a voltage difference will exist between the boards whenever a current flows from one board to the other. The ground plate provides a low impedance means to reduce the voltage difference to as close to zero as possible thereby helping to reduce the creation of electromagnetic interference. Second, the ground plate provides a mechanical support between the two printed circuit boards to maintain the printed circuit boards in their spaced relationship within housing 12. This eliminates all kinds of extraneous components, flanges, bosses, etc. to support the printed circuit boards. Third, it can be seen that the ground plate is disposed at a location between the printed circuit boards extending across an entire width of the boards creating two compartments, one for power and the other for data. Therefore, the ground plate provides electromagnetic interference isolation between the 120 volt power circuitry and the 5 to 12 volt data signals. Fourth, ground plate 26 acts as a heat sink to dissipate heat from transformer 28. It can be seen in FIG. 3 that the transformer is mounted on one side of the ground plate and coupled, without electrical contact to the ground plate, to the third printed circuit board 30 which, in turn, is electrically coupled, as at 72, to lower printed circuit board 24. The ground plate, being fabricated of thermally and electrically conductive material, such as metal, dissipates heat from the transformer or from other electronic components which might be mounted directly to the ground plate. Like power terminals 66 and 68 and data terminals 70, ground plate 26 includes a terminal blade 74 projecting through housing 12 for grounding the entire electrical connector circuitry to ground outside the connector assembly.

Figure 6:
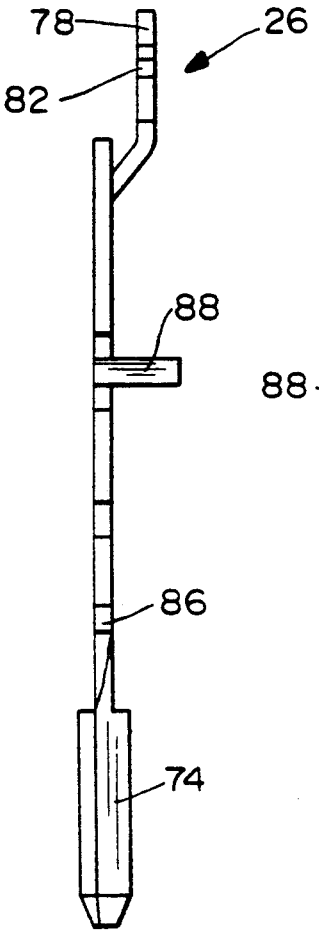
FIG. 6 is a side elevational view of the ground plate.
Figure 4:
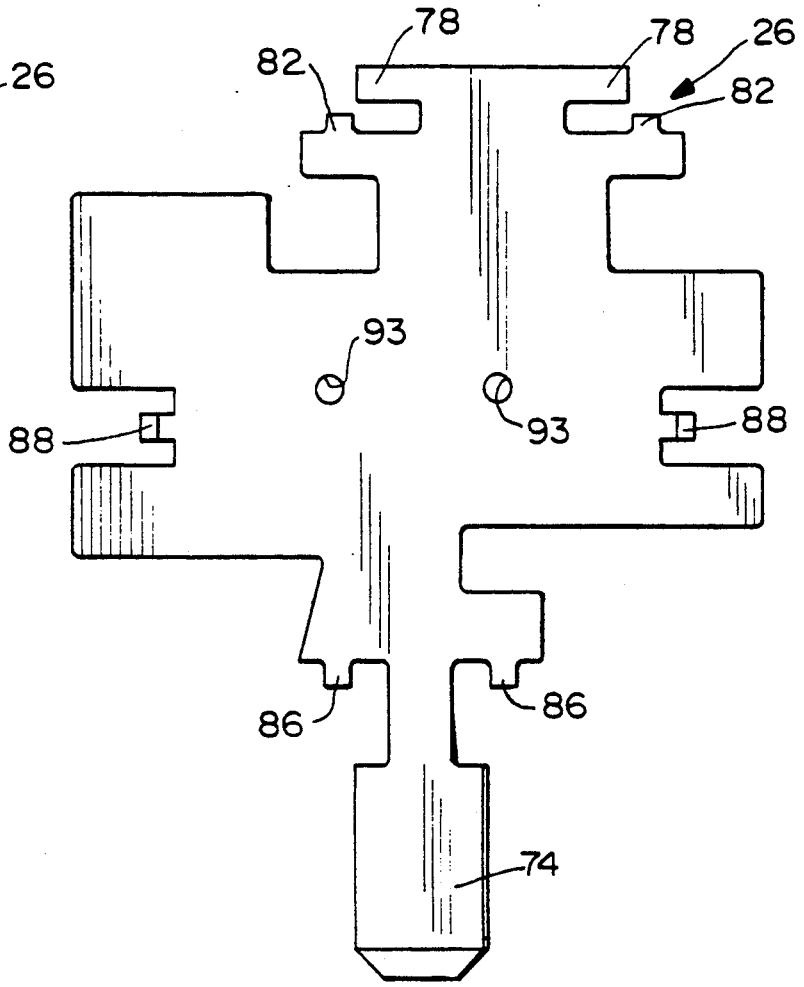
FIG. 4 is a side elevational view of the ground plate of the assembly.
Figure 5:
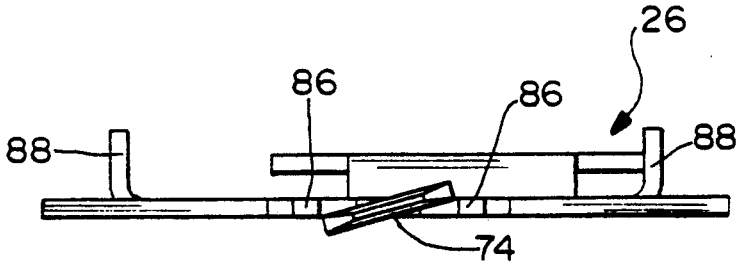
FIG. 5 is a bottom plan view of the ground plate.

Referring to FIGS. 4–6 in conjunction with FIGS. 1 and 3, ground plate 26 is fabricated as a unitary component, such as being stamped from sheet metal material. The ground plate is completely assembled within the connector assembly without any extraneous components. Specifically, the top of the ground plate includes a cross-bar portion defining a pair of end tabs 78. The cross-bar portion is inserted through a slot 80 (FIG. 1) in first or upper printed circuit board 22, and tabs 78 then are bent at an angle to the ground plate necessary to lock the ground plate to the upper printed circuit board, as bosses 82 of the ground plate engage the underside of the upper printed circuit board. Terminal or blade portion 74 of the ground plate is inserted into a slot 84 in the second or lower printed circuit board 24. It can be seen in FIG. 1 that slot 84 is oblique in relationship to slot 80 in printed circuit board 22. During manufacture, terminal or blade portion 74 of the ground plate is twisted approximately 15°. In assembly, once the blade portion is inserted through slot 84, the blade portion again is twisted back to a position generally coplanar with the ground plate to lock the blade portion against the underside of housing 12 as bosses 86 of the ground plate engage the top of the lower printed circuit board. Still further, a pair of fingers 88 are formed out of the plane of the ground plate for insertion into mounting holes 90 in third printed circuit board 30 (FIG. 1). Therefore, the ground plate is sandwiched between transformer 28 and the third printed circuit board, as the ground plate acts as a heat sink for the transformer, with the transformer resting on the ground plate electrically connected to the third printed circuit board, by leads 91 passing through holes 93 in ground plane 26 (FIG. 1).

Figure 7:
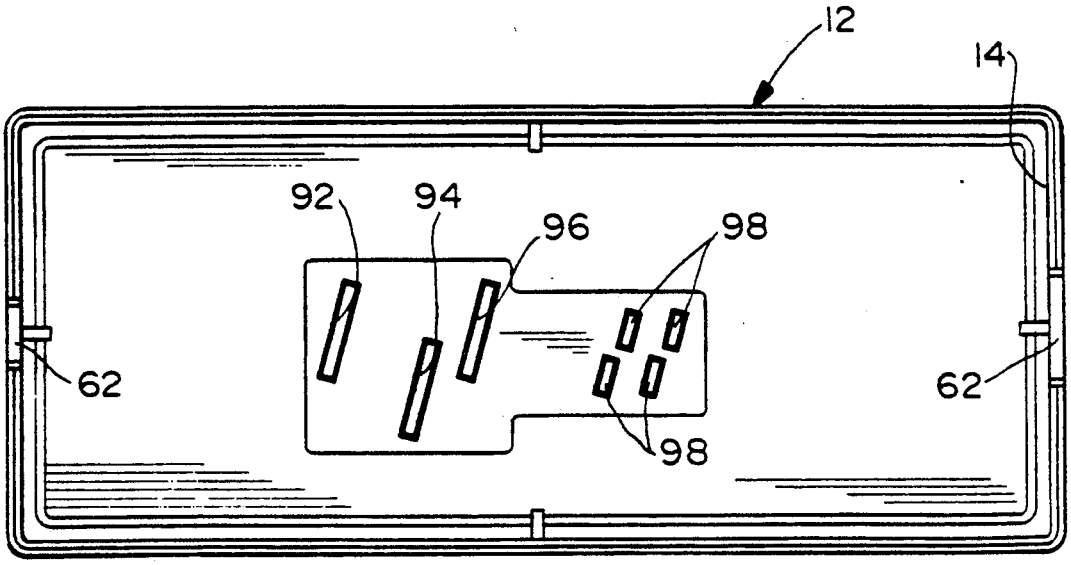
FIG. 7 is a top plan view looking down into the housing of the connector assembly.

Referring to FIG. 7, it can be seen that housing 12 has slots 92 and 94 for insertion therethrough of power terminals 66 and 68, respectively. Another slot 96 accommodates blade portion 74 of ground plate 26. Still additional slots 98 accommodate data terminals 70. it should be noted that all of these slots are oblique or at an angle to the longitudinal axis of the box-shaped or rectangular housing. Now, referring back to FIG. 1, it can be seen that power terminals 66 and 68 and data terminals 70 are mounted to printed circuit board 24 so as to be at similar oblique angles. Consequently, as described above in relation to the twisting of blade portion 74 of ground plate 26, all of the terminals can be inserted through the oblique slots in the housing and then twisted approximately 15° to secure the terminals relative to the housing without employing extraneous mounting components.

Figure 8:
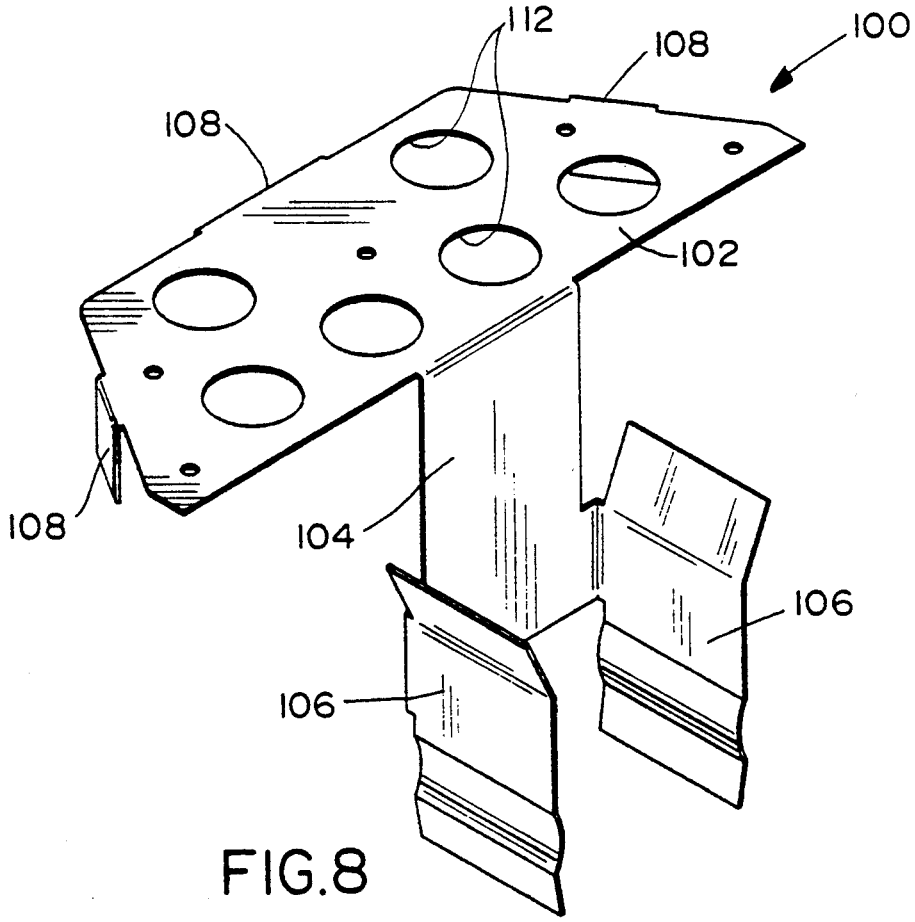
FIG. 8 is a perspective view of the electrical discharge shield plate of the assembly.

Lastly, referring to FIG. 8 in conjunction with FIG. 1, an electrical discharge shield plate, generally designated 100, is employed in the connector assembly, particularly associated with the data portion of the receptacle modules 18 and 20 as seen in FIG. 1. The electrical discharge shield plate includes a face plate portion 102, a depending leg portion 104, a pair of coupling arms 106 projecting transversely from leg portion 104, and a plurality of tabs 108 depending from face plate portion 102. As can be understood from FIG. 1, leg portion 104 and coupling arms 106 are inserted into an aperture 110 in the receptacle modules 18 and 20 for embracing and engaging the ground terminal 36 thereof. Face plate portion 102 overlies the top surface of the receptacle module about data terminal passages 46, and an array of holes 112 are provided in the face plate portion aligned with the data terminal passages. Tabs 108 of the electrical discharge shield plate overlie the outside walls of the portion of the data receptacle module. The face plate portion 102 underlies face cover 16. Holes 112 should be sufficiently enlarged so that they do not come in contact with contact pins of a mating data connector. With the electrical discharge shield plate grounded to ground terminal 36, the shield plate will discharge any static electricity created during mating with a complementary connector rather than the static electricity discharging into the internal electronics of the electrical connector assembly.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector assembly which includes a pair of spaced receptacle modules mounted to a first printed circuit board which is electrically coupled to a second printed circuit board spaced in a different plane from and generally parallel to the first printed circuit board, wherein the improvement comprises a conductive ground plate electrically coupled between the printed circuit boards and mechanically supporting the circuit boards in their spaced generally parallel relationship, the ground plate being disposed perpendicular to the first and second printed circuit boards forming two separate compartments between the first and second printed circuit boards to provide electromagnetic interference isolation between said compartments and a transformer mounted on one side of the ground plate between the spaced generally parallel printed circuit boards, the ground plate providing a heat sink for the transformer and the transformer electrically coupled to an electrical component through the ground plate.

2. In an electrical connector assembly as set forth in claim 1, including circuit means coupled between the first and second printed circuit boards.

3. In an electrical connector assembly as set forth in claim 1, including a dielectric housing encasing the receptacle modules, the first and second printed circuit boards and the ground plate.

4. In an electrical connector assembly as set forth in claim 3, wherein the housing has an open front end, and including a face cover mounted on the housing closing the open front end thereof, the face cover including aperture means communicating with the receptacle modules.

5. In an electrical connector assembly as set forth in claim 3, wherein said housing includes a rear wall, and including terminal means electrically coupled to the second printed circuit board and extending through the rear wall.

6. In an electrical connector assembly as set forth in claim 5, wherein said ground plate includes a terminal portion extending through the rear wall of the housing.

7. In an electrical connector assembly which includes a pair of spaced generally parallel printed circuit boards and a transformer for electrical connection in circuit with at least one of the circuit boards, wherein the improvement comprises a conductive ground plate electrically coupled between the printed circuit boards and to mechanically support the circuit boards in their spaced generally parallel relationship, the transformer being mounted on one side of the ground plate whereby the ground plate provides a heat sink for the transformer and a third printed circuit board mounted on the opposite side of the ground plate and electrically coupled to the transformer through the ground plate.

8. In an electrical connector assembly which includes a pair of spaced receptacle modules mounted to a first printed circuit board which is electrically coupled to a second printed circuit board spaced from and generally parallel to the first printed circuit board, wherein the improvement comprises a conductive ground plate electrically coupled between the printed circuit boards and mechanically supporting the circuit boards in their spaced generally parallel relationship, the ground plate being disposed perpendicular to the first and second printed circuit boards forming two separate compartments between the first and second printed circuit boards to provide electromagnetic interference isolation between said compartments and a transformer mounted on one side of the ground plate between the spaced generally parallel printed circuit boards, the ground plate providing a heat sink for the transformer and a third printed circuit board mounted on the side of the ground plate opposite the transformer and electrically coupled to the transformer through the ground plate.

9. In an electrical connector assembly as set forth in claim 8, including circuit means coupled between the third printed circuit board and the second printed circuit board.

* * * * *